United States Patent [19]

Mysiak et al.

[11] 4,036,545

[45] July 19, 1977

[54] CONNECTOR ASSEMBLY

[75] Inventors: Eugene J. Mysiak, Cicero; Allen J. Bury, Prospect Heights, both of Ill.

[73] Assignee: Molex Incorporated, Lisle, Ill.

[21] Appl. No.: 683,963

[22] Filed: May 6, 1976

[51] Int. Cl.[2] ..... H01R 9/08

[52] U.S. Cl. ..... 339/95 D; 339/97 R

[58] Field of Search ..... 339/95, 97–99

[56] References Cited

U.S. PATENT DOCUMENTS

| | | | |
|---|---|---|---|
| 3,977,754 | 8/1976 | Brummans | 339/95 D |
| 3,979,615 | 9/1976 | Neff | 339/95 D |

FOREIGN PATENT DOCUMENTS

| | | | |
|---|---|---|---|
| 1,285,589 | 12/1968 | Germany | 339/95 D |
| 751,675 | 7/1956 | United Kingdom | 339/95 D |

*Primary Examiner*—Joseph H. McGlynn
*Attorney, Agent, or Firm*—Louis A. Hecht

[57] ABSTRACT

A connector assembly for electrically connecting a first wire to a second insulation clad wire. A connector assembly generally comprises a unitary terminal including a relatively rigid portion having a wire trap means for receiving a conductive part of the first wire and a wire piercing side with a first insulation cutting edge formed thereon. The terminal also includes a resilient portion spaced from the wire piercing side having a second insulation cutting edge thereon facing the first cutting edge. The space between the first and second cutting edges defines an insulation displacement slot for receiving the second wire. The cutting edges are spaced a distance not less than the diameter of the conductive part of the first wire. The assembly also comprises a housing with an opening through which the terminal is receivable. The housing generally includes a first compartment for receiving the rigid portion of the terminal and the first wire. The housing also includes a second compartment spaced from the first compartment for receiving the resilient portion of the terminal. A wire loading slot is defined between the first and second compartments for receiving the second wire prior to engagement with the terminal. The compartments have means allowing communication with the loading slot. The second compartment has a cam surface formed thereon for engagement with the resilient portion for moving the second cutting edge toward the first cutting edge as the terminal is inserted into the housing. In this manner the cutting edge displaces the insulation of the second wire at the loading slot and engages the conductive part thereof.

3 Claims, 4 Drawing Figures

CONNECTOR ASSEMBLY

BACKGROUND OF THE INVENTION

1. Field of the Invention

The present invention relates to electrical connectors.

2. Brief Description of the Prior Art

In the past, it has been required to effect an electrical connection between an insulation clad wire and a relatively thin second wire. An example of such an application is in a small appliance wherein it is desired to connect a small motor armature wire with a power wire.

The armature wire is very thin and is usually insulated with a coat of varnish or the like. Because of the thinness of this wire, it is prone to be easily cut or broken under any force of fatigue. Accordingly, conventional types of connectors have proven unsatisfactory. The main method of causing the connection between these two types of wires has been by a hand-solder operation.

Another problem facing manufacturers is the insulation displacement of a thin coating such as varnish on a thin gauge wire. As pointed out above, it is desirable to avoid the breaking of the wire under such an operation.

Although wire trap type terminals are well known in the art, it is always desirable to employ better and improved designs. It is important that a wire trap ensure good electrical contact with the stripped end of an insulation clad wire along as great an area as possible to prevent intermittencies.

SUMMARY OF THE INVENTION

One object of the present invention is to provide a new and improved wire-trap type terminal. One embodiment of the invention which is currently contemplated in furtherance of this object comprises a generally U-shaped body having first and second opposing wall portions joined at one end and open at the other end to mount a part of a wire between said wall portions. The first wall portion includes a longitudinal groove for receiving and guiding part of the wire between the wall portions. The second wall portion includes a first spring leg extending and abutting the first wall portion, slanting away from the open end and inclined relative to the second wall portion. The second wall portion also includes a second spring leg struck therefrom spaced from the first spring leg extending toward the first wall portion and slanting away from the open end. Both of said spring legs are adapted to press the wire against the terminal groove.

Another object of the present invention is to provide an improved means of displacing thin insulation from a thin gauged wire. One embodiment of the invention which is currently contemplated in furtherance of this object comprises a connector assembly including an insulation displacement terminal and a housing. The insulation displacement terminal includes a relatively rigid portion with a first insulation cutting edge formed thereon and a resilient portion spaced from the rigid portion having a second insulation cutting edge formed thereon facing and movable toward the first cutting edge. The space between the first and second cutting edges is defined in an insulation displacement slot for receiving a wire. The cutting edges are spaced a distance not less than the diameter of the conductive part of the wire. The housing has an opening through which the terminal is received. The housing includes a first compartment for receiving the rigid portion of the terminal and the wire and a second compartment spaced from the first compartment for receiving the resilient portion of the terminal. Both compartments have means allowing communication with a loading slot which is defined therebetween for receiving the wire prior to engagement with the terminal. The second compartment has a cam surface formed thereon for engagement with the resilient portion for moving the second cutting edge toward the first cutting edge as the terminal is inserted into the housing. In this manner the cutting edges displace the thin insulation of the thin guage wire at the loading slot and engage the conductive part thereof.

Still another object of the present invention is to provide an improved connector assembly for electrically connecting a first wire to a second insulation clad thin gauged wire. One embodiment of the invention which is currently contemplated in furtherance of this object provides for a connector assembly comprising a unitary terminal including a relatively rigid portion having a wire trap means for receiving a conductive part of the first wire and a wire piercing side with a first insulation cutting edge formed thereon. The terminal also includes a resilient portion spaced from the wire piercing side having a second insulation cutting edge formed thereon facing and movable toward the first cutting edge. The space between the first and second cutting edges defines an insulation displacement slot for receiving the second wire. The cutting edges are spaced a distance not less than the diameter of the conductive part of the first wire. The connector assembly also comprises a housing with an opening through which the terminal is received. The housing includes a first compartment for receiving the rigid portion of the terminal and the first wire and a second compartment spaced from the first compartment for receiving the resilient portion of the terminal. A wire loading slot is defined between the first and second compartments for receiving the second wire prior to engagement with the terminal. A wire loading slot is defined between the first and second compartments for receiving the second wire prior to engagement with the terminal. The compartment has means allowing communication with the loading slot. The second compartment has a cam surface formed thereon for engagement with the resilient portion for moving the second cutting edge toward the first cutting edge as the terminal is inserted into the housing. In this manner, the cutting edges displace the insulation of the second wire at the loading slot and engage the conductive part thereof.

DESCRIPTION OF THE PREFERRED EMBODIMENT

Figure 1:
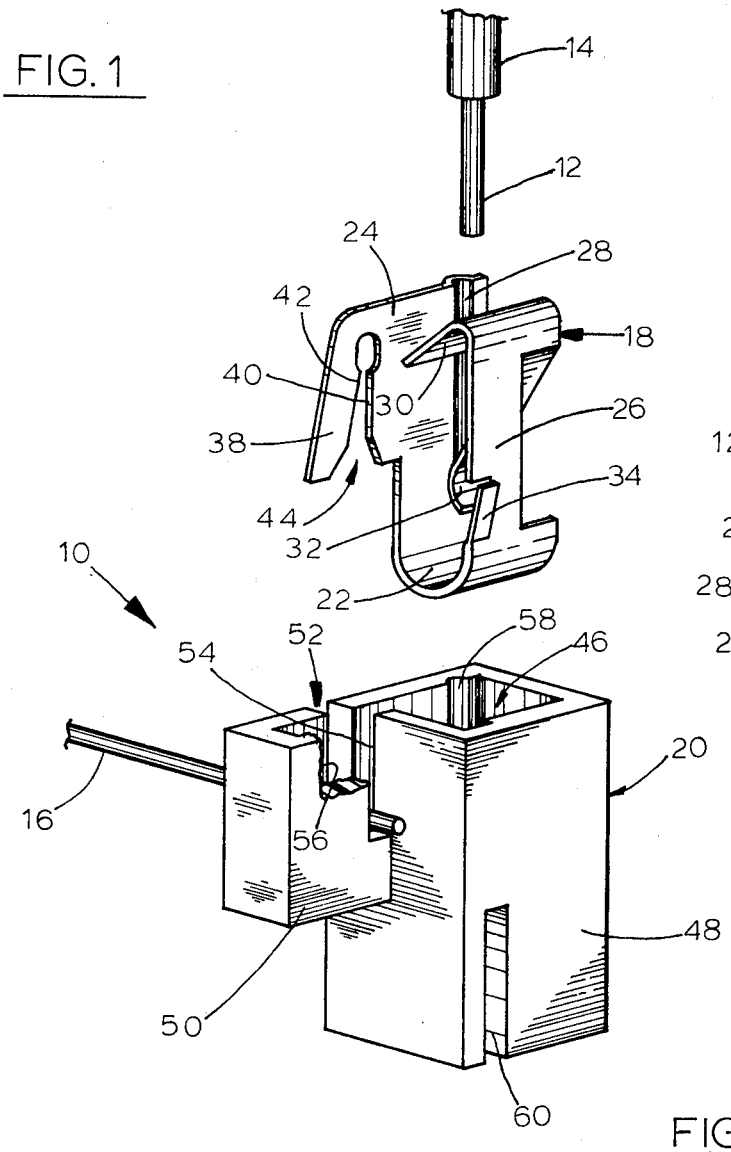
FIG. 1 is an enlarged perspective exploded partially fragmented view of the connector assembly of the present invention.

Turning now to the drawings, the connector assembly, generally designated 10, of the present invention is shown. The connector assembly 10 is intended to connect the conductive part 12 of a first wire 14 with a thin gauged, thin insulated second wire 16. The electrical connection between the wires 14 and 16 is effected by means of a unitary terminal, generally designated 18, which is insertable into an insulated housing, generally designated 20, in a manner which will be described in greater detail hereinafter.

Figure 2:
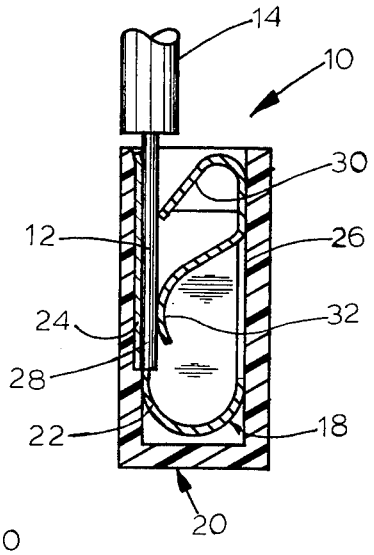
FIG. 2 is a side elevation of the terminal employed in the connector assembly of the present invention.

Turning now to FIGS. 1 and 2 in particular, the terminal 18 is seen to include a generally U-shaped rigid body portion 22 having first and second opposing wall portions 24 and 26 joined at one end and open at the other end to mount the conductive part 12 of wire 14 therebetween. The first wall portion 24 includes a longitudinal groove 28 for receiving and guiding the conductive part 12 of wire 14.

The second wall portion 26 includes a spring leg 30 extending toward and abutting the first wall portion 24 and slants away from the open end inclined relative to the second wall portion 26. The second wall portion also includes a second spring leg 32 struck therefrom and spaced from the first spring leg 30. The second spring leg 32 extends toward the first wall portion and slants away from the open end.

The rigid body portion 22 also includes a locking tang 34 struck therefrom. The locking tang 34 cooperates with the housing 20 in a manner which will be discussed in greater detail hereinafter.

The terminal 18 also includes a resilient portion 38 formed adjacent to but spaced from the rigid body portion 22. The side of the rigid body portion adjacent the resilient portion 38 has a first insulation cutting edge 40 formed thereon. The resilient portion 38 has a second insulation cutting edge 42 formed thereon facing and movable toward the first cutting edge 40.

The space between the first and second cutting edges 40 and 42 defines insulation displacement slot 44 for receiving the thin gauged wire 16 therein. The distance between cutting edges 40 and 42 is not less than the diameter of the wire 16.

The housing 20 has an opening 46 (FIG. 1) in the top thereof through which the terminal 18 is receivable. The housing 20 includes a first compartment 48 for receiving the rigid body portion 22 of the terminal 18 and the conductive part 12 of wire 14. A second, generally L-shaped compartment 50 is spaced from the first compartment 48 and receives the resilient portion 38 of the terminal 18 therein. A wire loading slot 52 (FIG. 1) is defined between the first and second compartments 48 and 50, respectively, for receiving the thin gauged wire 16 prior to insertion of the terminal 18.

The first and second compartments 48 and 50, respectively, each has an opening 54 and 56 respectively, (FIG. 1) facing each other and allowing communication between the compartments and the loading slot 52. When the terminal 18 is fully inserted, the cutting edges 40 and 42 thereof are allowed thereby to extend into the loading slot 52.

The first compartment 48 has a vertical groove 58 (FIG. 1) formed along one wall thereof to receive the terminal groove 28 formed with the terminal 18 when the terminal 18 is inserted into the housing 20. A locking slot 60 is also formed in the first compartment and is adapted to cooperate with the locking tang 34 of the terminal 18 to prevent withdrawal of the terminal after insertion into the housing 20.

Figure 4:
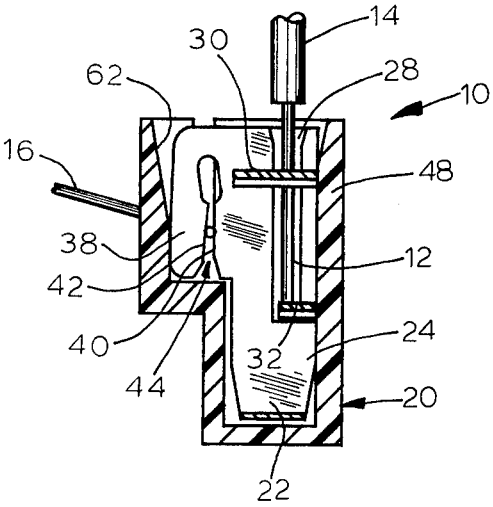
FIG. 4 is a side sectional view of the connector assembly of the present invention after the terminal has been fully inserted into the housing.

The second compartment 50 has a cam surface 62 (FIG. 4) formed in the interior thereof. Cam surface 62 is adapted to engage the resilient portion 38. Because the cam surface 62 is tapered inwardly toward the loading slot 52, the cutting edge 42 will be moved further into the loading slot 52 as the terminal 18 is received into the housing 20.

Figure 3:
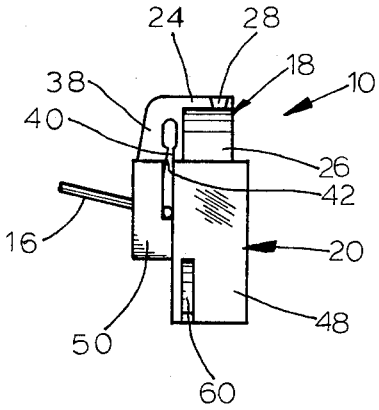
FIG. 3 is a side elevational view of the connector assembly of the present invention just prior to complete insertion of the terminal into the housing.

In use, a thin gauged varnish coated wire 16 such as a small motor armature wire, is placed in the loading slot 52 of empty housing 20. The terminal 18 is then placed initially in the housing 20 as best shown in FIG. 3. After being placed in the housing 20, the terminal is then pushed inwardly to a position shown in FIG. 4. When pushed inwardly to the position shown in FIG. 4, the cam surface 62 causes the resilient portion 38 of terminal 18 to move inwardly toward the loading slot 52 so that the cutting edge 42 engages the wire 16. Because the pressure exerted between the two cutting edges 40 and 42 against the wire 16 is very gradually applied, the possibility that the wire 16 may break is greatly lessened.

After the terminal 18 is fully inserted, a conductive part 12 of the wire 14 is then pushed inwardly into the groove 28 so that the first and second spring legs 30 and 32 engage the conductive part. Unlike prior art devices which afford an electrical connection by pressing a single spring leg against a terminal wall, the wire trap terminal of the present invention employs the second spring leg 32 to press the conductive part 12 of wire 14 at a second point. In this manner, the conductive part is pressed against the terminal groove 28. Because of the second spring leg 32, a better electrical connection between the wire 14 and terminal 18 is effected.

It is to be understood that the design of the insulation displacement structure of terminal 18 and the manner in which it cooperates with housing 20 can be employed without the wire trap feature. That is, one can manufacture a terminal similar to the terminal 18 without the wire trap feature and employ the principle disclosed herein to displace a varnish coating on a thin gauge wire.

Likewise, one could use the wire trap feature without employing the insulation displacement feature. That is, a terminal can be built similar to terminal 18 without the resilient portion 38 or the cutting edges 40 and 42. In this manner, the resulting terminal would be one that would be used solely for wire trap purposes.

We claim:

1. A connector assembly for electrically connecting a first wire to a second insulation clad wire comprising:

a unitary terminal including a relatively rigid portion having a wire trap means for receiving a conductive part of the first wire and a wire piercing side with a first insulation cutting edge formed thereon, said terminal further including a resilient portion spaced from said wire piercing side having a second insulation cutting edge formed thereon facing and movable toward said first cutting edge, the space between said first and second cutting edges defining an insulation displacement slot for receiving said second wire and being spaced a distance not less than the diameter of the conductive part of said first wire; and a housing with an opening through which said terminal is receivable, said housing including a first compartment for receiving the rigid portion of the terminal and said first wire, a second compartment spaced from the first compartment for receiving the resilient portion of the terminal, and a wire loading slot defined between said first and second compartments for receiving said second wire prior to engagement with said terminal, said compartments having means allowing communication with the loading slot, said second compartment having a cam surface formed thereon for engagement with the resilient portion for moving the second cutting edge toward the first cutting edge as the terminal is inserted into the housing, whereby said cutting edges displace the insulation of the second wire at the loading slot and engage the conductive part thereof.

2. The connector assembly of claim 1 including means cooperating between said housing and terminal for locking the terminal in the housing after insertion thereof.

3. A connector assembly comprising:

an insulation displacement terminal including a relatively rigid portion with a first insulation cutting edge formed thereon and a resilient portion spaced from said rigid portion having a second insulation cutting edge formed thereon facing and movable toward the first cutting edge, the space between said first and second cutting edges defines an insulation displacement slot for receiving a wire and being spaced a distance not less than the diameter of the conductive part of the wire; and a housing with an opening through which said terminal is receivable, said housing including a first compartment for receiving the rigid portion of the terminal and said wire and a second compartment spaced from the first compartment for receiving the resilient portion of the terminal, said compartments having means allowing communication with a loading slot defined therebetween for receiving said wire prior to engagement with said terminal, said second compartment having a cam surface formed thereon for engagement with the resilient portion for moving the second cutting edge toward the first cutting edge as the terminal is inserted into the housing, whereby said cutting edges displace the insulation of the wire at the loading slot and engage the conductive part thereof.

* * * * *